US006067926A

United States Patent [19]

Robinson

[11] Patent Number: 6,067,926

[45] Date of Patent: May 30, 2000

[54] PORTABLE TELESCOPING BOAT DOCK

[75] Inventor: Craig D. Robinson, 13035 Lubert St., Salinas, Calif. 93906

[73] Assignee: Craig D. Robinson, St. Salinas, Calif.

[21] Appl. No.: 09/189,426

[22] Filed: Nov. 10, 1998

[51] Int. Cl.[7] ..... B63B 17/00

[52] U.S. Cl. ..... 114/362; 114/263; 405/219

[58] Field of Search ..... 114/362, 263, 114/264; 405/218, 219, 220; 14/71.1

[56] References Cited

U.S. PATENT DOCUMENTS

| | | | |
|---|---|---|---|
| 4,142,477 | 3/1979 | Powers | 114/263 |
| 4,161,795 | 7/1979 | Quest | 9/1.6 |
| 4,287,625 | 9/1981 | Dawson | 9/1.6 |
| 4,990,029 | 2/1991 | Hemminger | 405/203 |
| 5,085,165 | 2/1992 | Reed | 114/362 |
| 5,165,823 | 11/1992 | Cupples | 405/219 |
| 5,829,380 | 11/1998 | Smith | 114/362 |

*Primary Examiner*—Jesus D. Sotelo
*Assistant Examiner*—Lars A. Olson

[57] ABSTRACT

A portable boat dock and ramp, whose overall length is adjustable telescopically, one end of which connects to a swim step of a water skiing boat or other boat equipped with a swim step and the other end of which is anchored to a shoreline, thereby providing a secure mooring of said boat to said shoreline as well as providing a bridge between said shoreline and said boat for ingress and egress of people, equipment and supplies. One section of said boat dock fits slidably inside the other section for transport and storage. In use, an inside ramp section slidably projects or telescopes-out of the outside ramp section to create a ramp whose overall length can be up to almost twice the length of a single ramp section. A cushioned, "U" shaped channel, which connects to the swim step of a boat, is fixed at one end of said dock. A polystyrene foam board is installed inside said inside ramp section to provide adequate buoyancy for floatation when a boat is not moored to said dock. Tie down accessories are securely stored inside said inner boat dock section during transportation or storage.

1 Claim, 5 Drawing Sheets

22
11
18

19

22

21
23

15
21

21
14
23
15

21
23
14

PORTABLE TELESCOPING BOAT DOCK

BACKGROUND

1. Field of Invention

The field of invention relates to a portable, boat dock and ramp, whose length can be adjusted telescopically, for water skiing boats and other sport/pleasure boats equipped with a swim step at their stern to which said portable boat dock connects, allowing people to ingress and egress without going into the water when the boat is moored, thus integrating mooring, docking and ramp access.

2. Description of Prior Art

Pleasure and sport boating often includes onshore activities such as picnicking or camping in areas where permanent docks are not available. Water skiing activities with purpose-built, water skiing boats in particular necessitate going to and from the shoreline to drop off and pick up people and equipment. Without a dock or a ramp from shore to boat, people are required to wade through the water to move from boat to shore or shore to boat. This makes simple ingress and egress as well as carrying supplies and equipment to and from the boat not only difficult, but messy because of the mud and sand that is brought into the boat from the lake/river/stream bottom, and sometimes dangerous due to objects under water.

As a result, several forms of portable dock or ramp have come forth to address this problem. Prior art is exemplified in U.S. Pat. No. 5,165,823 to Cupples which provides a foldable ramp which attaches to the bow of a boat; and in U.S. Pat. No. 4,287,625 to Dawson which uses a relatively large deck structure with an elongated outrigger for stabilizing the dock; and in U.S. Pat. No. 4,161,795 to Quest which provides an even more complex structure which attaches to the bow of a boat and has retractable legs which rest on a shoreline.

The present invention is specifically designed to accommodate water skiing boats and other boats provided with swim steps on their sterns. The swim step is attached to the stern of a boat to provide a platform or step at water level on which people can stand while they prepare to enter the water. Water skiing boats in particular are designed for activity at the back of the boat. Ingress and egress over the stern is easily accommodated by these kinds of boats. The aforementioned prior art which attach to boats either at the bow or the side are not ideal for water skiing activities.

Prior art does not adequately accommodate water skiing boats in particular, nor does any prior art make use of a boat's swim step.

OBJECTS AND ADVANTAGES

The several objects and advantages of the present invention are:

(a) to provide a temporary, portable dock which consists of a ramp from a shoreline to a boat utilizing the swim step of said boat as the attachment point on said boat for said dock and provides access for loading and unloading people and equipment over the stern of said boat without stepping in the water.

(b) to provide a temporary, portable dock, which incrementally adjusts up to almost twice its retracted length, for docking and securely mooring a boat further from a shoreline in deeper water in order to protect elements of said boat that are below said boat's water line, while still maintaining said dock's excellent portability when said dock is in a retracted, transportable configuration.

(c) to provide a temporary dock which floats in the water and remains connected to a shoreline when a boat is not moored to said dock.

(d) to provide a temporary, portable dock of adjustable length that is both simple and inexpensive to manufacture while also providing great strength and durability.

(e) to provide a temporary, portable dock that contains all said dock's tie-down and mooring accessories securely within the body of said dock when said dock is in its retracted, transportable configuration.

(e) to provide a dock that is small and light enough to be carried by a person, and not only fit easily into the type of boat it is meant to service, but also fit easily on a trailer, truck, van or mobile home which transports said dock.

DRAWING FIGURES

DESCRIPTION OF THE PREFERRED EMBODIMENTS

Figure 1:
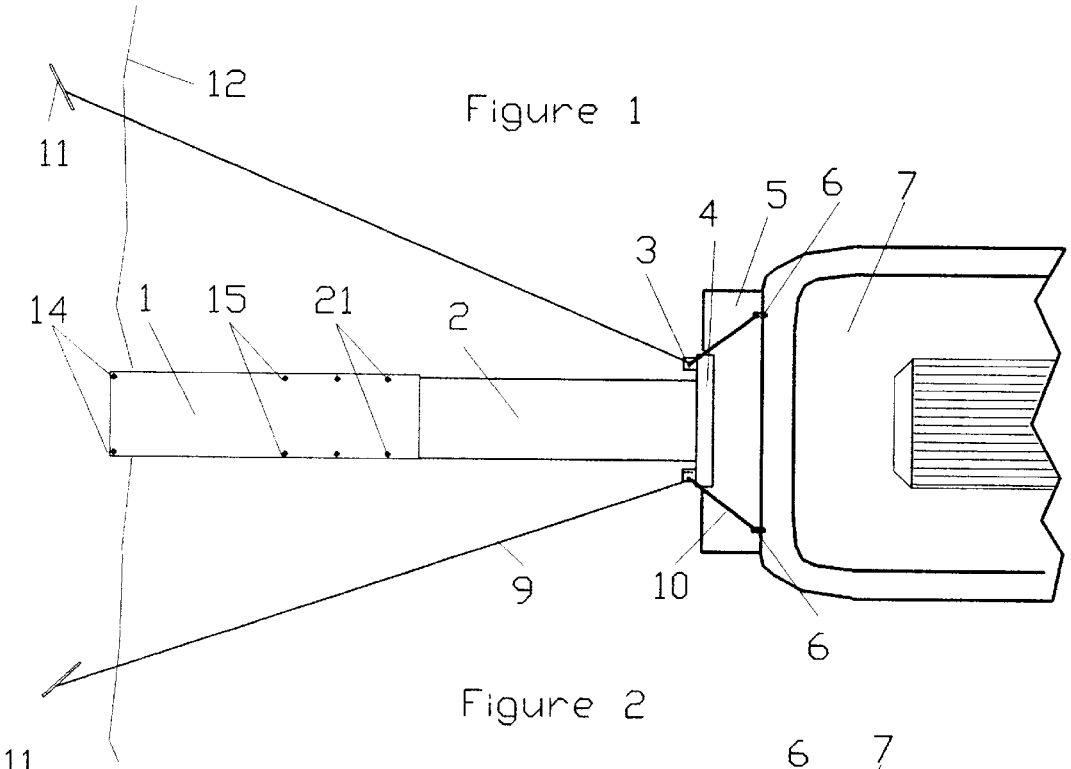
FIG. 1 shows a top view of a portable boat dock anchored to a shoreline at one end of said dock and a water skiing boat secured to the other end of said dock.
Figure 2:
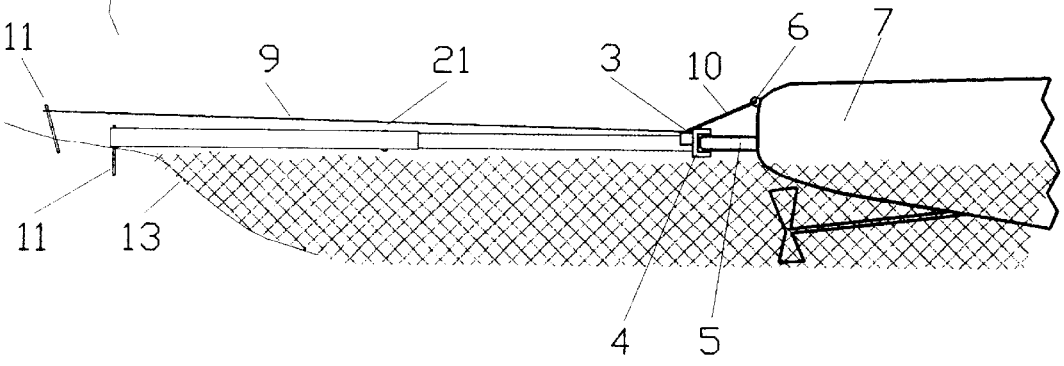
FIG. 2 shows a side view of a portable boat dock anchored to a shoreline at one end of said dock and a water skiing boat secured to the other end of said dock.

A typical embodiment of a portable, floating, boat dock shown in FIG. 1 shows one end 2 of said dock attached at the swim step 5 of a water skiing boat and the opposite end 1 of said dock anchored to a shoreline 12. In the preferred embodiment as shown in FIGS. 1 and 2, a boat-connection device 4 engages with the swim step 5 at the back end or stern of a boat. One end of a strap 10 is tied to a tie-down bracket 3 attached to said boat-connection device 4 and the other end of said strap 10 is tied to mooring rings 6 at the back of said boat. This connects said boat securely to said dock.

FIGS. 1 and 2 show said dock's inside and outside dock sections in their operational configuration and locked into place by locking pins 21. One end of a rope 9 is tied to said tie-down bracket 3 attached to said boat-connection device 4 and the other end of said rope 9 is tied to stakes 11 driven into a shoreline. FIGS. 1, 7, 8 and 15 show the stake holes 14 in the end of said outside dock section through which said stakes 11 are driven into said shoreline. This connects said dock securely to said shoreline.

Figure 3:
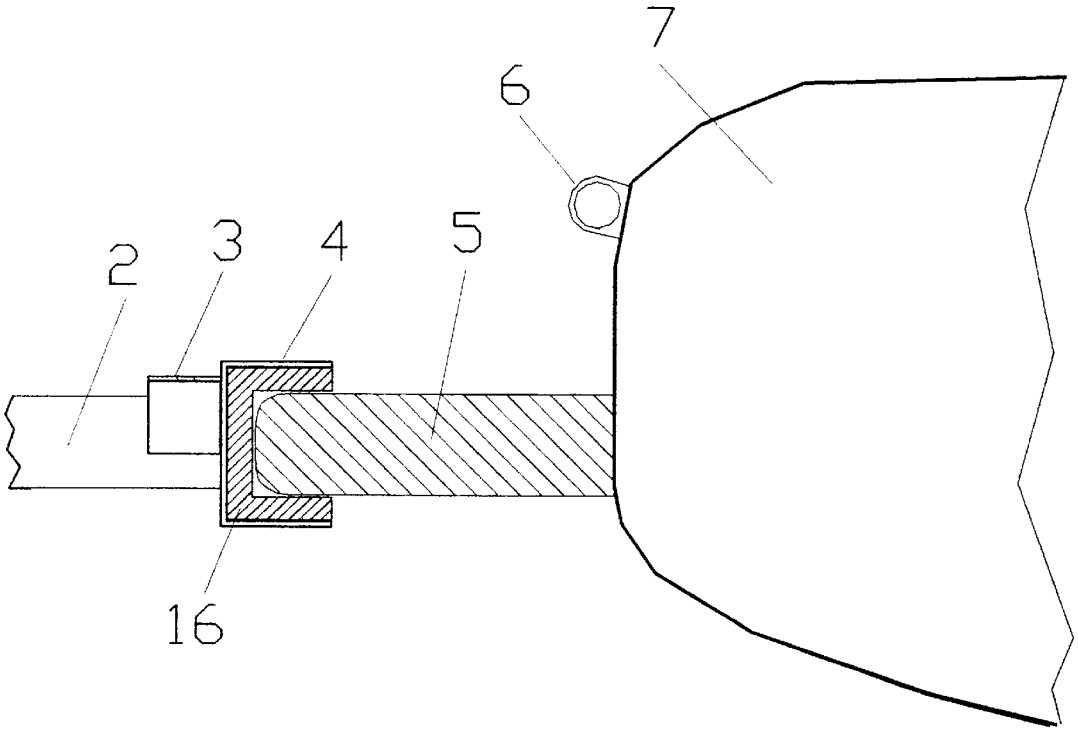
FIG. 3 shows a close-up, side view of the interface of a boat's swim step and said boat dock's boat-connection device.
Figure 4:
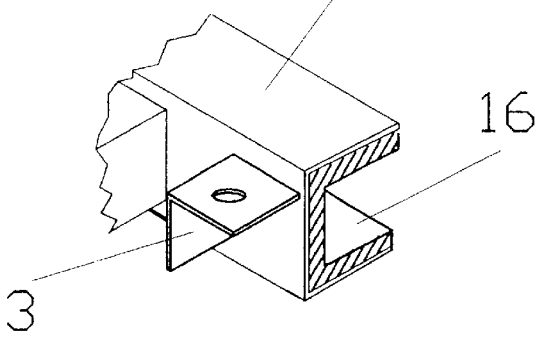
FIG. 4 shows a tie-down bracket and a foam cushion attached to said boat-connection device.

FIG. 3 shows a typical embodiment of said boat-connection device as a "U" shaped, formed channel 4 lined with a cushion 16 made from foam rubber or plastic foam material of a predetermined thickness to protect said boat's swim step 5 and allow for small movements of said dock and said boat due to the action of waves. Said tie-down bracket 3 as shown in FIG. 4 consists of a formed angle with a hole in one leg. Said formed angle is welded to said boat-connection device 4. Said inside dock section 2 is welded to said boat-connection device 4.

Figure 5:
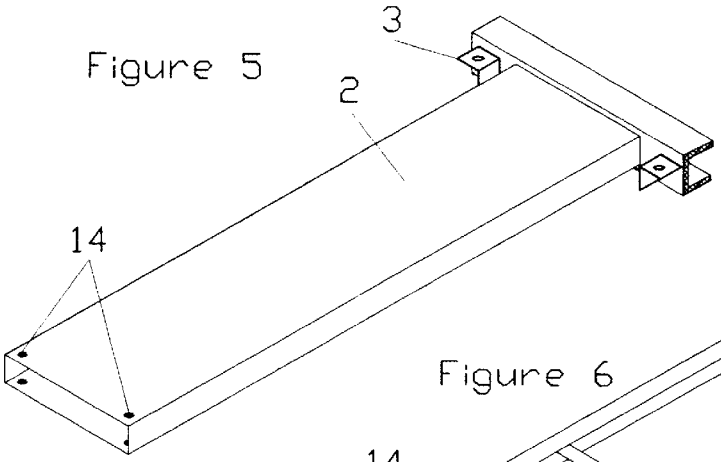
FIG. 5 shows a top view of an inside ramp section of said dock.
Figure 6:
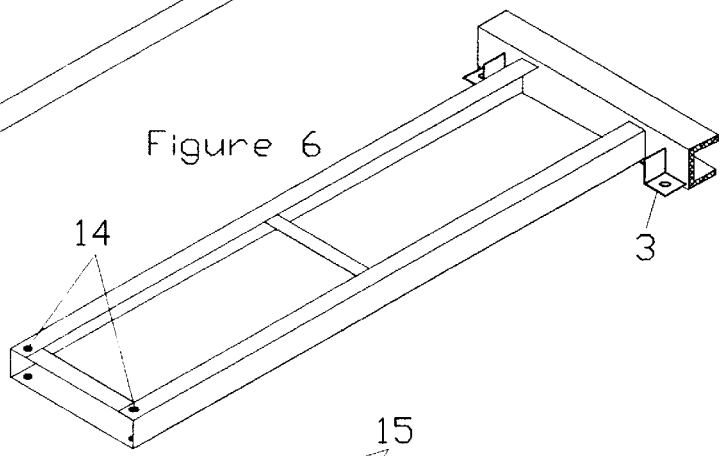
FIG. 6 shows a bottom view of said inside ramp section of said dock.
Figure 7:
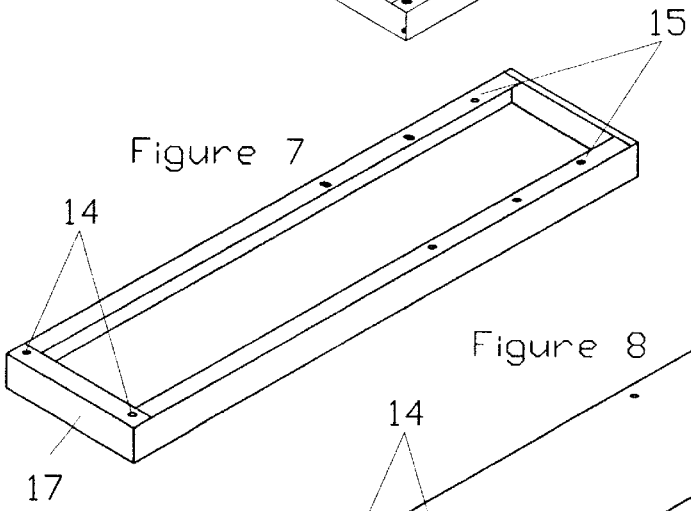
FIG. 7 shows a bottom view of an outside ramp section of said dock.
Figure 8:
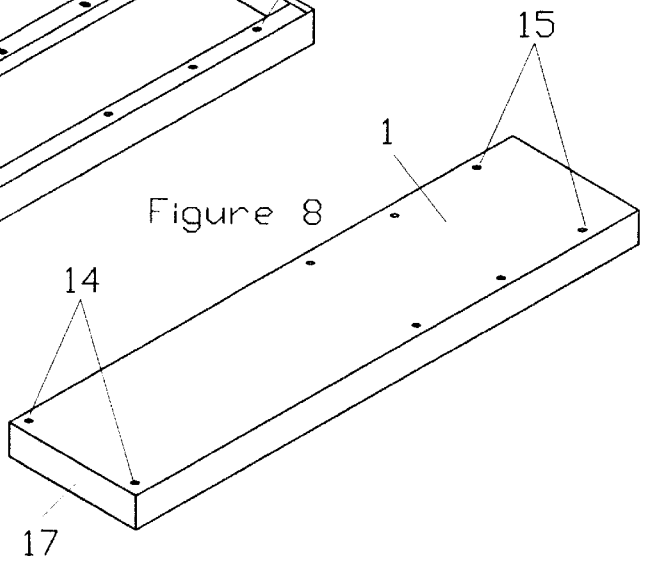
FIG. 8 shows an top view of said outside ramp section of said dock

A typical embodiment of an inside dock section is illustrated in FIGS. 5 and 6. Aluminum, non-skid, diamond plate is used to fabricate said ramp section 2 and welded to a boat-connection device 4. A typical embodiment of said outside dock section is illustrated in FIGS. 7 and 8. Aluminum, non-skid, diamond plate is used to fabricate said ramp section 1 with the diamond plate formed to cap the end 17 of said outside dock section.

Figures 9, 10, 11:
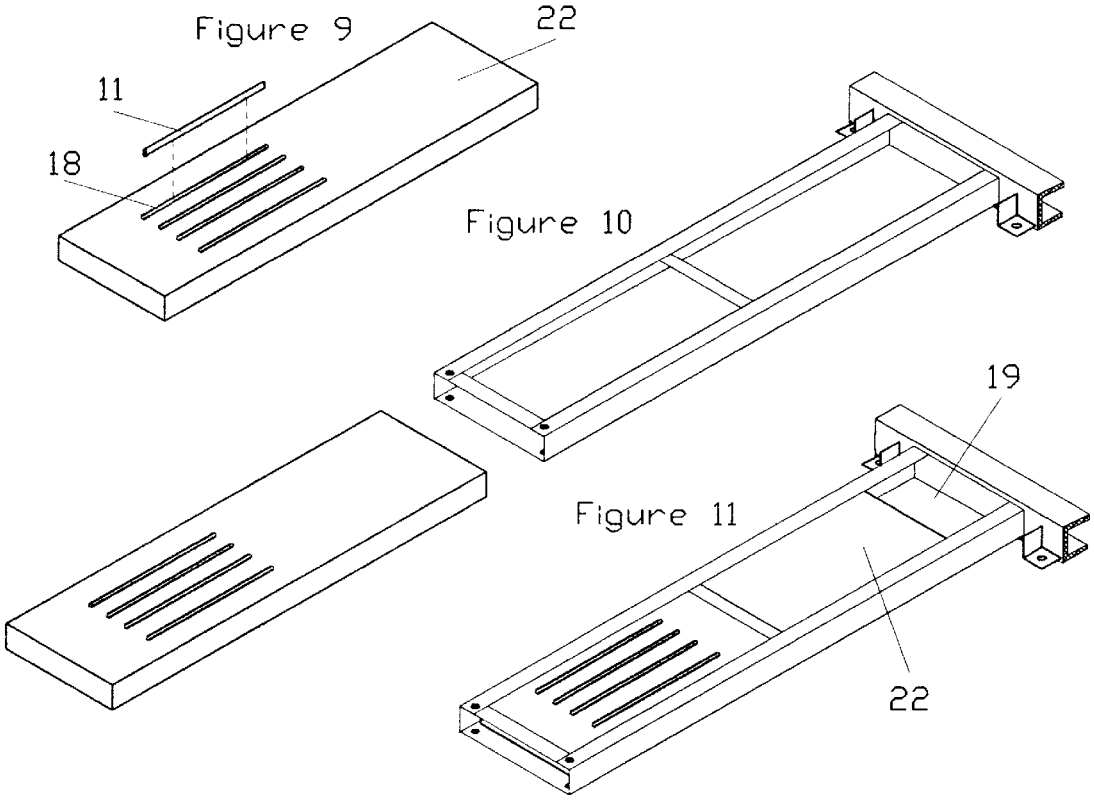
FIG. 9 shows a foam, floatation insert with molded-in stake pockets, and stakes.
FIG. 10 shows said floatation insert disposed to be inserted into said inside ramp section of said dock.
FIG. 11 shows said floatation insert fully inserted into said inside ramp section of said dock and a storage area for tie-down ropes and straps.
Figures 12, 13, 14, 15:
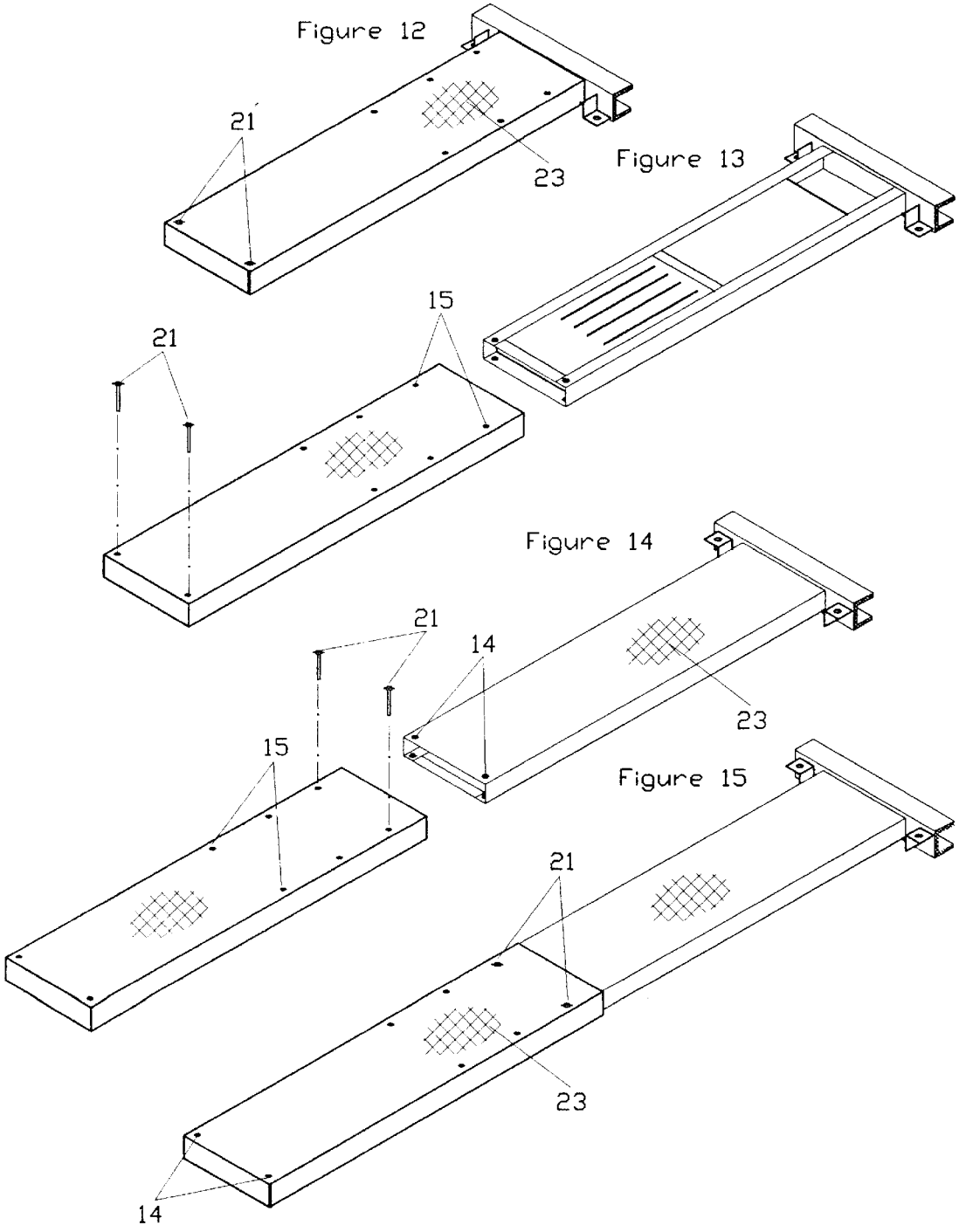
FIG. 12 shows said dock in retracted or transportable configuration.
FIG. 13 shows said inside dock section completely removed from said outside dock section.
FIG. 14 shows said inside dock section so that said inside dock section's solid, skid-resistant, top side is facing up and is aligned with said outside dock section.
FIG. 15 shows said dock sections assembled for use.

A typical embodiment of a floatation insert 22 made from polystyrene foam is shown in FIG. 9. Recesses 18 are molded or cut into said floatation insert 22 for the storage of said stakes 11. FIG. 10 shows said floatation insert 22 disposed for insertion into said inside dock section. FIG. 11 shows said floatation insert 22 fully inserted into position inside said inside dock section. A space 19 is created between said boat connection device 4 and the end of said floatation insert 22 for the storage of said straps 10 and said ropes 9. A typical embodiment of said dock's transportable configuration is shown in FIG. 12 wherein said inside dock section is fully inserted into said outside dock section and secured together by pins 21 through said stake holes 14 at the end of each said dock section. In said dock's transportable configuration, said inside dock section is inserted into said outside dock section so that said diamond-plate surface 23 of each said dock section is exposed to the outside elements. In said transportable configuration, said dock exposes a diamond-plate surface on five of the six outside surfaces of said dock. The sixth surface is covered by said boat connection device. Said transportable configuration provides a means to: protect said floatation insert 22, contain said stakes 11 in said recesses 18, and contain said ropes 10 & said straps 9 in said space 19. FIG. 13 shows said dock sections pulled apart from said dock's transportable configuration thereby exposing said recesses 18 containing said stakes 11 and said space 19 containing said straps 10 and said ropes 9.

A typical embodiment of the operational configuration of said dock requires that said inside dock section be removed completely from said outside dock section as shown in FIG. 13. Said inside dock section is then rotated 180 degrees around said inside dock section's longitudinal axis (flipped over) as shown in FIG. 14 with the result that said anti-skid surfaces 23 of both said dock sections are facing in the same direction, upward. Said inside dock section is inserted into said outside dock section up to the point where a pair of locking holes 15 of said outside dock section are aligned with a pair of said stake holes 14 in said inside dock section. Said pins 21 are inserted through said aligned holes as shown FIG. 15.

A typical embodiment of a fully installed and operational, telescoping, portable, boat dock and ramp for water skiing is show in FIGS. 1 and 2.

An alternate embodiment of the present invention would be to reverse the telescoping roles of the ramp sections. That is, a boat connection device could be attached to an outside ramp section and the end of an inside ramp section could be tied-down to a shoreline.

I claim:

1. A portable, floating boat dock structure of adjustable length comprising:

a two, separate ramp sections of predetermined dimensions such that one ramp section male, slidably fits inside a second ramp section, female, thereby providing a telescoping means for adjusting the overall length of said dock, b a means to secure said ramp sections together at different, fixed overall lengths, c a means to moor one end of said dock to the swimstep of a waterskiing boat or other boat equipped with a swim step, d a means of storing tie-down and mooring accessories inside said dock when said dock is in its transportable configuration, e a means to protect a flotation means, which resides inside said dock, from damage during transport and storage of said dock.

* * * * *